US009543659B2

(12) United States Patent
Takikawa et al.

(10) Patent No.: US 9,543,659 B2
(45) Date of Patent: Jan. 10, 2017

(54) REFLECTOR ANTENNA DEVICE

(71) Applicants: Michio Takikawa, Tokyo (JP); Yoshio Inasawa, Tokyo (JP); Tamotsu Nishino, Tokyo (JP)

(72) Inventors: Michio Takikawa, Tokyo (JP); Yoshio Inasawa, Tokyo (JP); Tamotsu Nishino, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 14/416,793

(22) PCT Filed: Mar. 27, 2013

(86) PCT No.: PCT/JP2013/058996
§ 371 (c)(1),
(2) Date: Jan. 23, 2015

(87) PCT Pub. No.: WO2014/061293
PCT Pub. Date: Apr. 24, 2014

(65) Prior Publication Data

US 2015/0207237 A1 Jul. 23, 2015

(30) Foreign Application Priority Data

Oct. 16, 2012 (JP) ..... 2012-228862

(51) Int. Cl.
*H01Q 13/00* (2006.01)
*H01Q 19/19* (2006.01)
(Continued)

(52) U.S. Cl.
CPC ..... *H01Q 19/192* (2013.01); *H01Q 19/17* (2013.01); *H01Q 19/191* (2013.01); *H01Q 1/288* (2013.01)

(58) Field of Classification Search
CPC .. H01Q 19/193; H01Q 19/191; H01Q 19/192; H01Q 19/17
(Continued)

(56) References Cited

U.S. PATENT DOCUMENTS 4,360,815 A * 11/1982 Mizuguchi ..... H01Q 19/17 343/781 P
5,113,197 A * 5/1992 Luh ..... H01Q 25/007 343/772
(Continued)

FOREIGN PATENT DOCUMENTS

JP 01-220903 A 9/1989
JP 03-003502 A 1/1991
(Continued)

OTHER PUBLICATIONS

An Office Action issued by the Japanese Patent Office on Sep. 29, 2015, which corresponds to Japanese Patent Application No. 2014-541960 and is related to U.S. Appl. No. 14/416,793; with English language partial translation.
(Continued)

*Primary Examiner* — Dieu H Duong
(74) *Attorney, Agent, or Firm* — Studebaker & Brackett PC

(57) ABSTRACT

A reflector antenna device is configured to include a main reflector 1 that has a rectangular aperture shape 2, and a primary radiator 3 that radiates a beam having a rectangular shape similar to the aperture shape 2 of the main reflector 1 onto the main reflector 1. As the primary radiator 3, a multimode horn antenna, an active phased array antenna, or the like can be used. As a result, the degree of freedom of reflector shaping can be improved without causing reduction in efficiency.

3 Claims, 9 Drawing Sheets

(51) Int. Cl.
*H01Q 19/17* (2006.01)
*H01Q 1/28* (2006.01)

(58) Field of Classification Search
USPC ..... 343/781 CA, 791 CA, 781 P
See application file for complete search history.

(56) References Cited

U.S. PATENT DOCUMENTS

| | | | |
|---|---|---|---|
| 5,175,562 | A | 12/1992 | Rappaport |
| 6,211,842 | B1 | 4/2001 | Cousin et al. |

FOREIGN PATENT DOCUMENTS

| | | | |
|---|---|---|---|
| JP | 09-214247 | A | 8/1997 |
| JP | 10-229308 | A | 8/1998 |
| JP | 2003-243923 | A | 8/2003 |

OTHER PUBLICATIONS

International Search Report; PCT/JP2013/058996; Jun. 25, 2013.
J.Hartmann et al.; "Advanced Communication Satellite Technologies"; Workshop on Space Borne Antenne and Measurement Techniques; Apr. 18, 2002; ISRO; pp. 1-15; Ahmedabad, India.
The extended European search report issued by the European Patent Office on May 3, 2016, which corresponds to European Patent Application No. 13846682.6-1811 and is related to U.S. Appl. No. 14/416,793.
M. Sanad et al.; "A Low Wind Load Lightweight Dual Cylindrical Reflector Antenna with a Novel Feed for Direct Broadcast Satellite TV Reception"; 2010 Loughborough Antenna & Propagation Conference; Nov. 8-9, 2010; pp. 285-288; Loughborough, UK.

* cited by examiner

REFLECTOR ANTENNA DEVICE

FIELD OF THE INVENTION

The present invention relates to a reflector antenna device used for, for example, satellite communications.

BACKGROUND OF THE INVENTION

As a satellite-mounted shaped beam antenna, a reflector antenna whose aperture shape, in which asperities are formed on a mirror surface, is a circular shape is generally used in order to make it possible to transmit and receive a beam according to a requested service area.

For recent satellite-mounted shaped beam antennas, there is an increasing demand for improvements in the gain, suppression of the isolation, etc. than ever before.

As a measure to meet this demand, for example, there can be provided a method of improving the degree of freedom for forming asperities on the mirror surface, and enlarging the circular aperture shape which the main reflector has.

However, because the size of an antenna which can be mounted in a satellite is limited from satellite mounting constraints due to the fairing of rockets, the degree of freedom of reflector shaping is limited.

Therefore, in order to make it possible to maximize the utilization of the aperture area under the satellite mounting constraints, it is effective to use a main reflector having a rectangular aperture shape in which the four corners of its circular aperture is enlarged as long as it can be mounted.

A main reflector having such a rectangular aperture shape is disclosed by, for example, the following nonpatent reference 1.

RELATED ART DOCUMENT

Nonpatent Reference

Nonpatent reference 1: J. Hartmann, J. Habersack, H.-J. Steiner, M. Lieke, "ADVANCED COMMUNICATION SATELLITE TECHNOLOGIES," Workshop on Space Borne Antennae Technologies and Measurement Techniques, 18. April 2002, ISRO, Ahmedabad, India.

SUMMARY OF THE INVENTION

Problems to be Solved by the Invention

Because the conventional reflector antenna device is constructed as above, even if a main reflector having a rectangular aperture shape is used, the shape of the beam radiated from the primary radiator onto the main reflector is a circular shape (refer to FIG. 9). Therefore, in the main reflector having a rectangular shape, the radiation level of a peripheral part (in the example of FIG. 9, a part close to each of the four corners of the aperture shape) which is enlarged from the circular shape decreases, and the degree of freedom of reflector shaping cannot be improved sufficiently. A problem is that as the radiation level of the peripheral part is increased conversely, the loss of spillover from a portion (in the example of FIG. 9, a portion close to the center of the aperture shape) which is not enlarged from the circular shape increases, and the efficiency degrades.

The present invention is made in order to solve the above-mentioned problems, and it is therefore an object of the present invention to provide a reflector antenna device that can improve the degree of freedom of reflector shaping without causing reduction in efficiency.

Means for Solving the Problem

In accordance with the present invention, there is provided a reflector antenna device including: a main reflector that has a rectangular aperture shape; a primary radiator that radiates a circle-shaped beam; and a subreflector that converts the shape of the beam radiated by the primary radiator from the circular shape to a rectangular shape similar to the aperture shape of the main reflector and reflects the beam, and that radiates the beam having the rectangular shape onto the main reflector.

Advantages of the Invention

Because the reflector antenna device in accordance with the present invention is configured in such away as to include: the main reflector that has a rectangular aperture shape; the primary radiator that radiates a circle-shaped beam; and the subreflector that converts the shape of the beam radiated by the primary radiator from the circular shape to a rectangular shape similar to the aperture shape of the main reflector and reflects the beam, and that radiates the beam having the rectangular shape onto the main reflector, there is provided an advantage of being able to improve the degree of freedom of reflector shaping without causing reduction in efficiency.

EMBODIMENTS OF THE INVENTION

Hereafter, in order to explain this invention in greater detail, the preferred embodiments of the present invention will be described with reference to the accompanying drawings.

Embodiment 1

Figure 1:
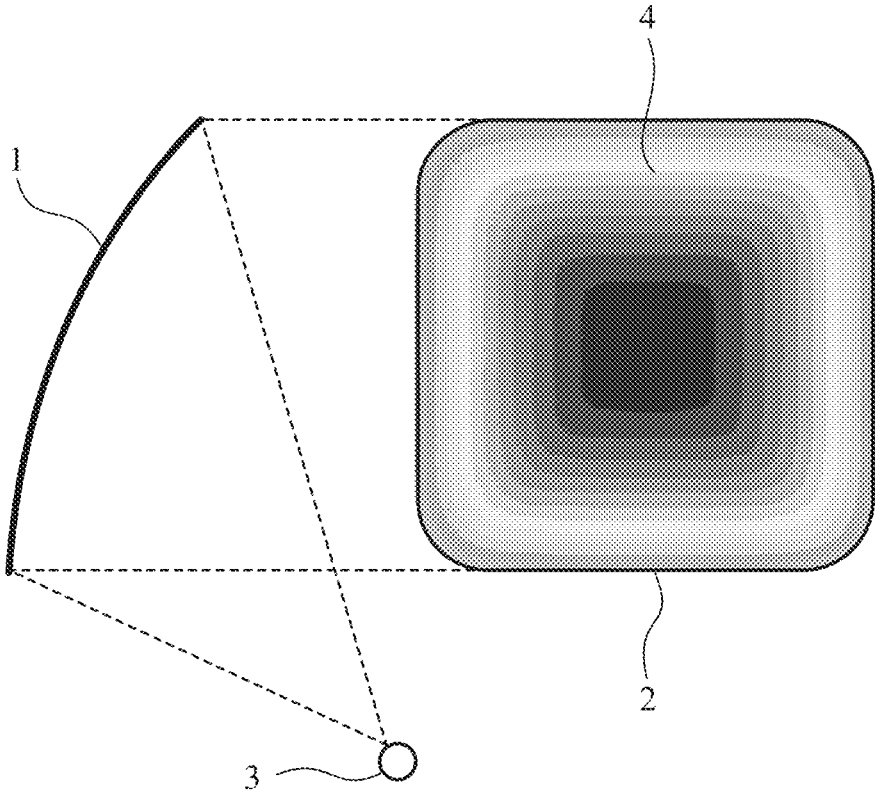
FIG. 1 is a structural diagram showing a reflector antenna device in accordance with Embodiment 1 of the present invention.

FIG. 1 is a structural diagram showing a reflector antenna device in accordance with Embodiment 1 of the present invention.

In FIG. 1, across section of the reflector antenna device, an aperture shape at the time when a main reflector 1 is viewed from the front, and a distribution of the amplitude of a beam radiated onto the aperture of the main reflector 1 are described.

Referring to FIG. 1, asperities are formed on the mirror surface of the main reflector 1 in order to form a beam, and the main reflector 1 has a rectangular aperture shape 2.

A primary radiator 3 is a source of radio wave radiation that radiates a beam having a rectangular shape similar to the aperture shape 2 of the main reflector 1 onto the main reflector 1. The primary radiator 3 constructs a beam radiator.

The amplitude distribution 4 is the amplitude distribution of the beam radiated onto the main reflector 1 by the primary radiator 3.

Next, an operation will be explained.

The beam having a rectangular shape emitted from the primary radiator 3 is reflected by the main reflector 1, and the beam having the rectangular shape reflected by the main reflector 1 is radiated in a determined direction (a direction of a requested service area).

At this time, the amplitude distribution of the beam radiated onto the main reflector 1 turns into the one like the amplitude distribution 4 shown in FIG. 1.

Figure 9:
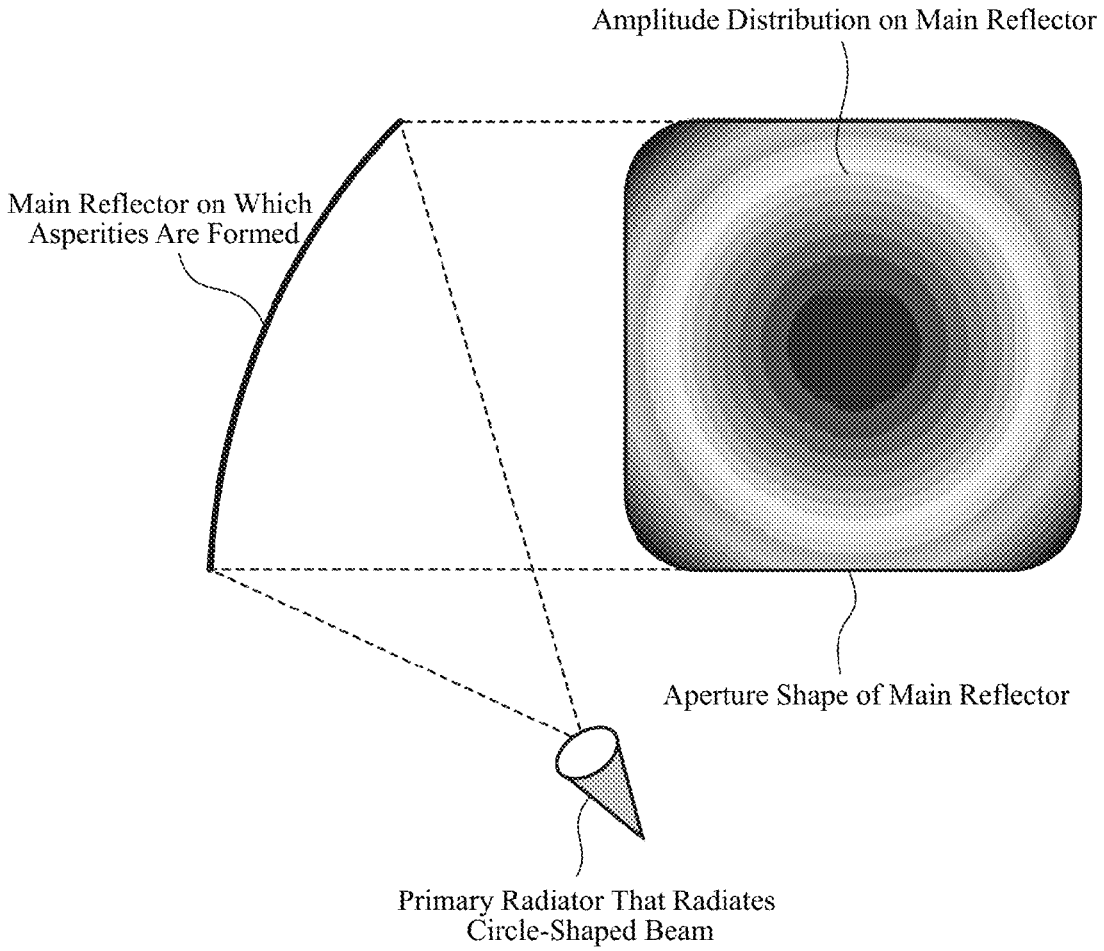
FIG. 9 is a structural diagram showing a reflector antenna device using a main reflector, which is disclosed by nonpatent reference 1.

In the conventional reflector antenna device shown in FIG. 9, the amplitude distribution on the main reflector decreases to less than the amplitude distribution 4 shown in FIG. 1 at a point close to any one of the four corners of the aperture shape. Therefore, in the whole region of the aperture shape, a difference occurs in the energy.

Figure 2:
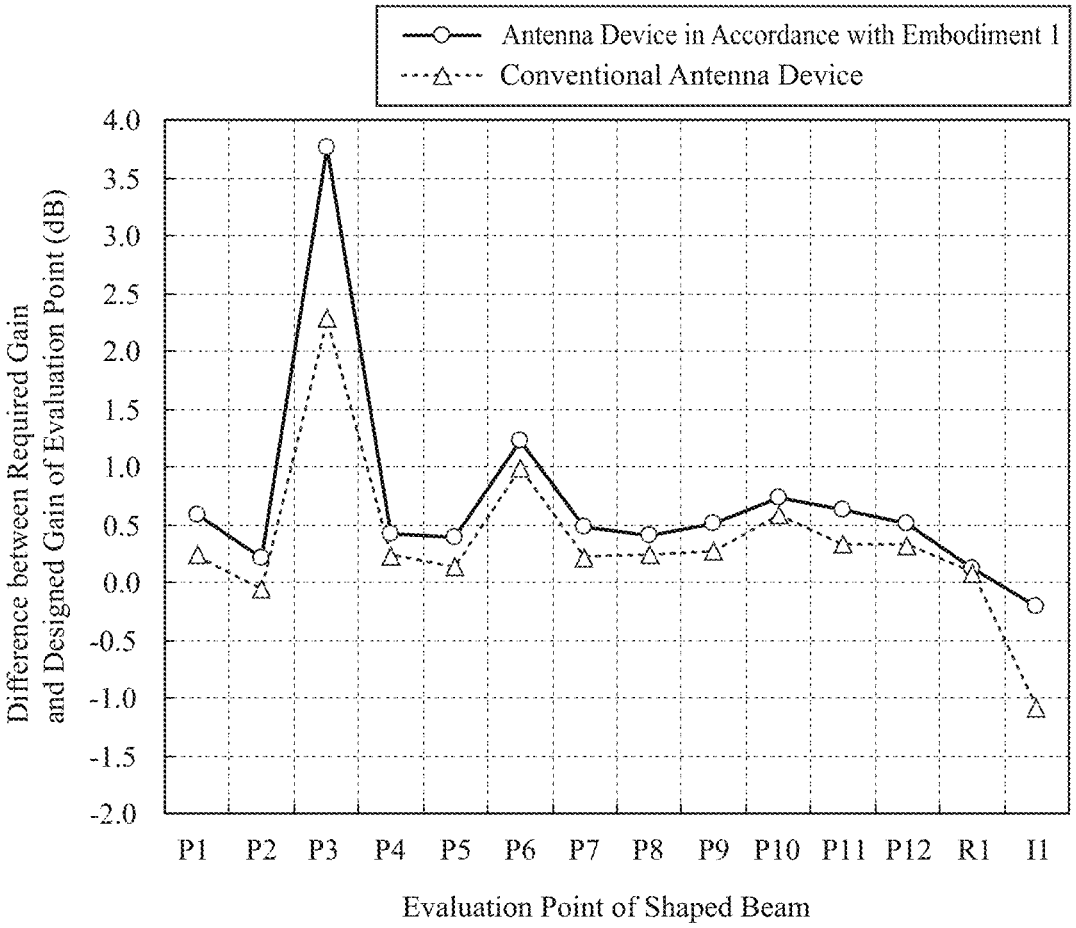
FIG. 2 is an explanatory drawing showing an example of comparison of evaluation points of a shaped beam of the reflector antenna device in accordance with Embodiment 1 with those of a conventional reflector antenna device.

FIG. 2 is an explanatory drawing showing an example of comparison of evaluation points of the shaped beam of the reflector antenna device in accordance with Embodiment 1 with those of the conventional reflector antenna device.

P1 to P12 and R1 in the horizontal axis of FIG. 2 denote evaluation points at each of which a gain is evaluated, and I1 denotes an evaluation point at which isolation is evaluated.

Further, the vertical axis of FIG. 2 shows the difference between a required gain or a required isolation value, and its designed value at each of the evaluation points, and the reflector antenna device increases in performance as this value approaches zero.

It has been recognized that the reflector antenna device in accordance with this Embodiment 1 increases in gain by 0.2 dB or more at each of the evaluation points P1 to P12 and R1, and also increases in isolation by about 1 dB at the evaluation point I1, as compared with the conventional reflector antenna device.

This means that the radiation of a beam having a shape similar to the aperture shape of the main reflector improves the degree of freedom of the determination of the asperities of the main reflector for forming the shaped beam, i.e., the degree of forming in the reflector shaping.

As can be seen from the above description, because the reflector antenna device in accordance with this Embodiment 1 is configured in such a way as to include the main reflector 1 that has a rectangular aperture shape 2, and the primary radiator 3 that radiates a beam having a rectangular shape similar to the aperture shape 2 of the main reflector 1 onto the main reflector 1, there is provided an advantage of being able to improve the degree of freedom of reflector shaping without causing reduction in efficiency.

Embodiment 2

Figure 3:
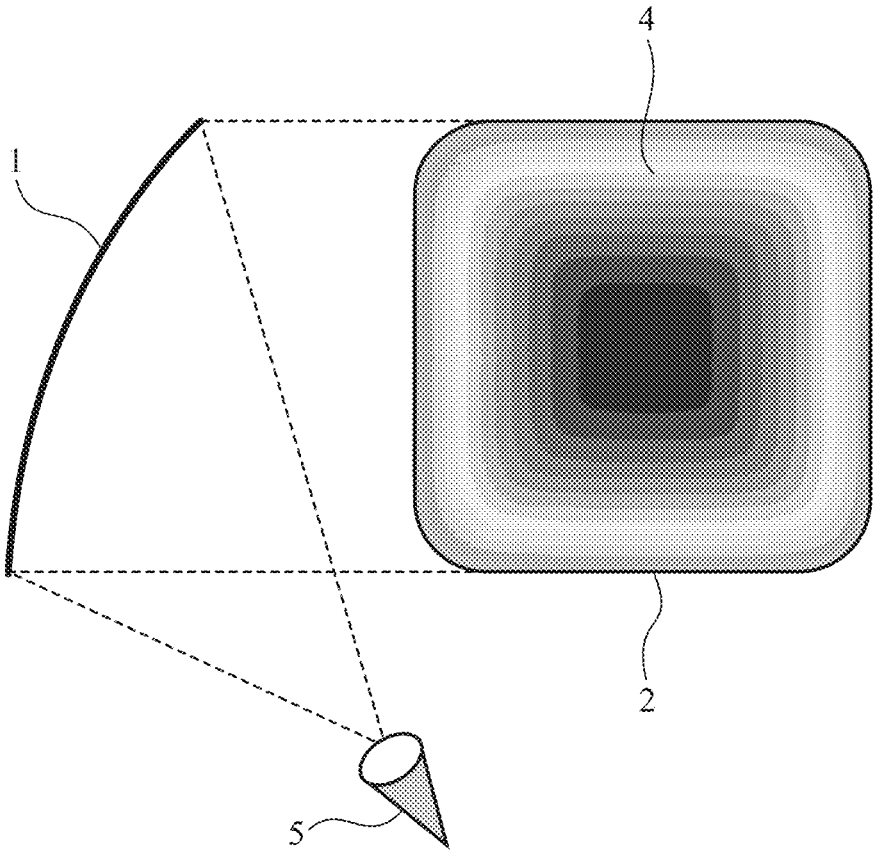
FIG. 3 is a structural diagram showing a reflector antenna device in accordance with Embodiment 2 of the present invention.

FIG. 3 is a structural diagram showing a reflector antenna device in accordance with Embodiment 2 of the present invention. In the figure, because the same reference numerals as those shown in FIG. 1 denote the same components or like components, the explanation of the components will be omitted hereafter.

A multimode horn antenna 5 is a horn antenna in which a plurality of waveguide modes are combined (for example, a fundamental mode and a plurality of higher modes of a waveguide are combined), and is a primary radiator that is configured in such a way as to radiate a beam having a rectangular shape. The multimode horn antenna 5 constructs a beam radiator.

Although the example in which the fundamental mode and the plurality of higher modes of the waveguide are combined is shown, this is only an example and the shape of the waveguide and the combination of the modes are not limited to those of the example.

Although this Embodiment 2 is an embodiment in which the multimode horn antenna 5 is used as the primary radiator, abeam having a rectangular shape similar to the aperture shape 2 of a main reflector 1 can be radiated onto the main reflector 1 also in the case in which the multimode horn antenna 5 is used as the primary radiator, like in the case of above-mentioned Embodiment 1. Therefore, there is provided an advantage of being able to improve the degree of freedom of reflector shaping without causing reduction in efficiency.

Embodiment 3

Figure 4:
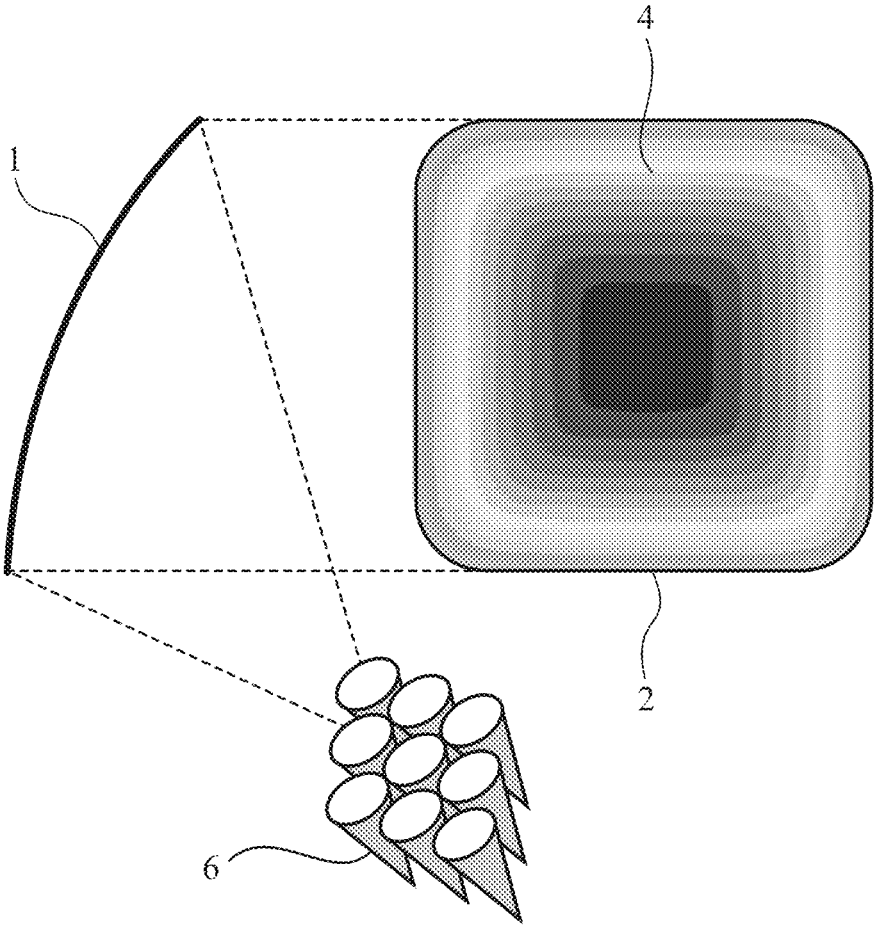
FIG. 4 is a structural diagram showing a reflector antenna device in accordance with Embodiment 3 of the present invention.

FIG. 4 is a structural diagram showing a reflector antenna device in accordance with Embodiment 3 of the present invention. In the figure, because the same reference numerals as those shown in FIG. 1 denote the same components or like components, the explanation of the components will be omitted hereafter.

An active phased array antenna 6 is a primary radiator that includes an amplifier and a phase shifter for each antenna element, and is configured in such a way as to radiate a beam having a rectangular shape by properly adjusting the amplification amount of each amplifier and the phase amount of each phase shifter to optimize each excitation coefficient of the primary radiator. The active phased array antenna 6 constructs a beam radiator.

Although this Embodiment 3 is an embodiment in which the active phased array antenna 6 is used as the primary radiator, a beam having a rectangular shape similar to the aperture shape 2 of a main reflector 1 can be radiated onto the main reflector 1 also in the case in which the active phased array antenna 6 is used as the primary radiator, like in the case of above-mentioned Embodiment 1. Therefore, there is provided an advantage of being able to improve the degree of freedom of reflector shaping without causing reduction in efficiency.

Embodiment 4

Figure 5:
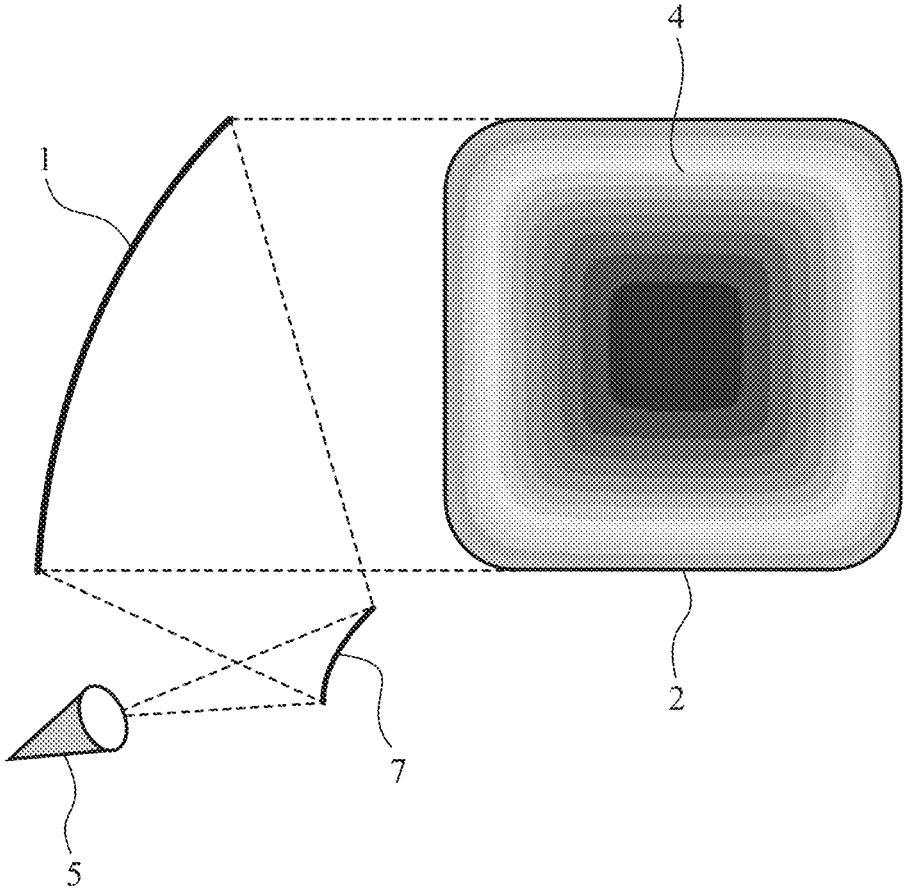
FIG. 5 is a structural diagram showing a reflector antenna device in accordance with Embodiment 4 of the present invention.

FIG. 5 is a structural diagram showing a reflector antenna device in accordance with Embodiment 4 of the present invention. In the figure, because the same reference numerals as those shown in FIG. 3 denote the same components or like components, the explanation of the components will be omitted hereafter.

A subreflector 7 is a Cassegrain-type reflector which has a rectangular aperture shape and whose mirror surface is a hyperboloid of revolution.

A beam radiator is comprised of a multimode horn antenna 5 and the subreflector 7.

Although the example in which a beam having a rectangular shape emitted from the multimode horn antenna 5 is radiated directly onto the main reflector 1 is shown in above-mentioned Embodiment 2, a beam having a rectangular shape emitted from the multimode horn antenna 5 can be reflected by the subreflector 7 having a rectangular aperture shape, and the beam having the rectangular shape reflected by the subreflector 7 can be radiated onto the main reflector 1. In this case, the same advantage as that provided by above-mentioned Embodiment 2 can be provided.

Embodiment 5

Figure 6:
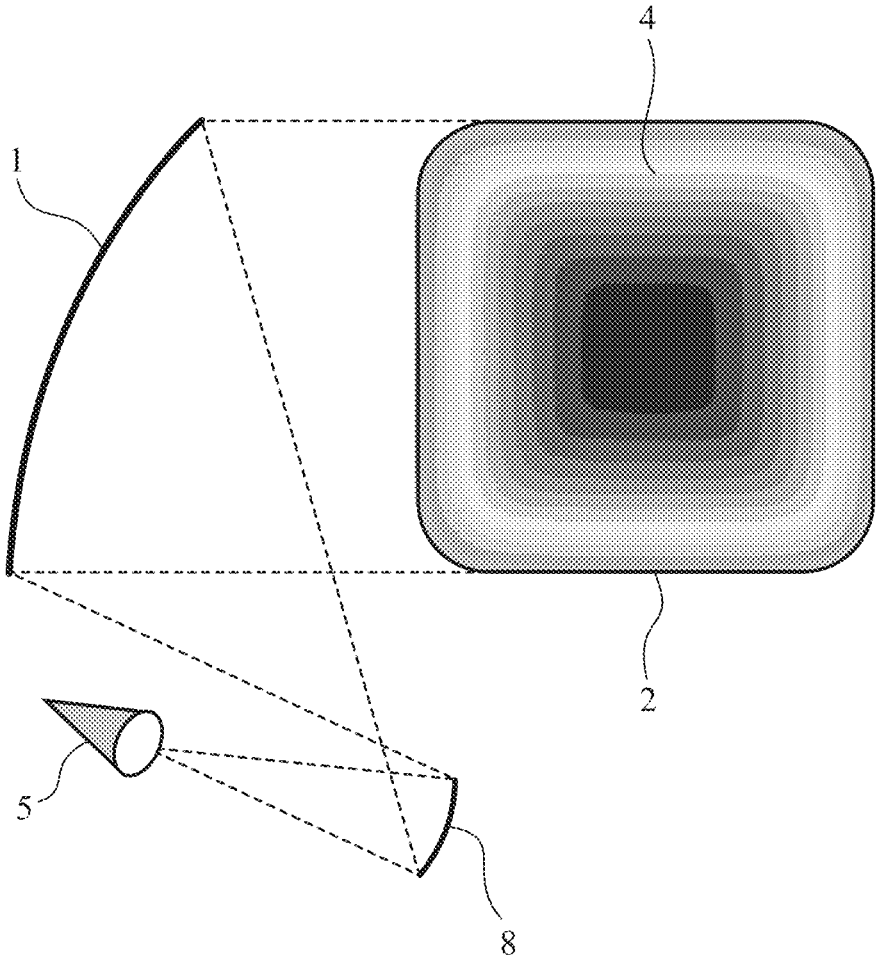
FIG. 6 is a structural diagram showing a reflector antenna device in accordance with Embodiment 5 of the present invention.

FIG. 6 is a structural diagram showing a reflector antenna device in accordance with Embodiment 5 of the present invention, In the figure, because the same reference numerals as those shown in FIG. 3 denote the same components or like components, the explanation of the components will be omitted hereafter.

A subreflector 8 is a Gregorian-type reflector which has a rectangular aperture shape and whose mirror surface is an ellipsoid of revolution.

A beam radiator is comprised of a multimode horn antenna 5 and the subreflector 8.

Although the example in which a beam having a rectangular shape emitted from the multimode horn antenna 5 is radiated directly onto the main reflector 1 is shown in above-mentioned Embodiment 2, a beam having a rectangular shape emitted from the multimode horn antenna 5 can be reflected by the subreflector 8 having a rectangular aperture shape, and the beam having the rectangular shape reflected by the subreflector 8 can be radiated onto the main reflector 1. In this case, the same advantage as that provided by above-mentioned Embodiment 2 can be provided.

Embodiment 6

Figure 7:
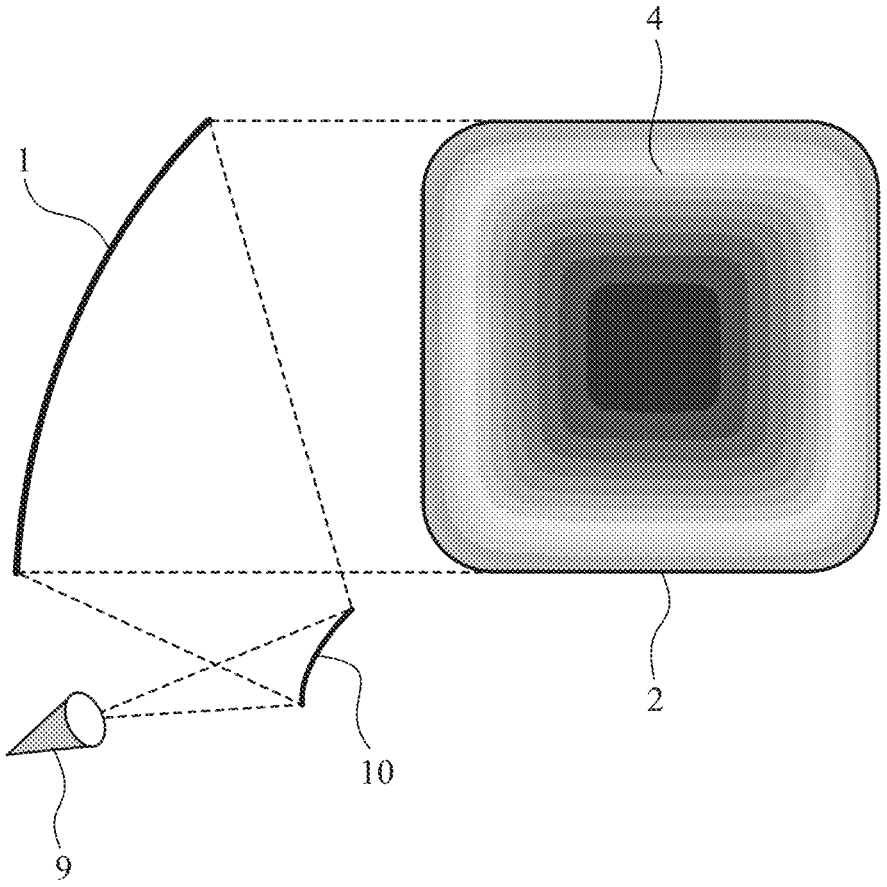
FIG. 7 is a structural diagram showing a reflector antenna device in accordance with Embodiment 6 of the present invention.

FIG. 7 is a structural diagram showing a reflector antenna device in accordance with Embodiment 6 of the present invention. In the figure, because the same reference numerals as those shown in FIG. 5 denote the same components or like components, the explanation of the components will be omitted hereafter.

A primary radiator 9 is a source of radio wave radiation that radiates a circle-shaped beam.

A subreflector 10 has a mirror surface on which asperities are formed in order to form a beam, and has a rectangular aperture shape.

Further, the mirror surface of the subreflector 10 is shaped in such a way as to, when reflecting the beam radiated by the primary radiator 9, convert the shape of the beam from the circular shape to a rectangular shape, and the beam having the rectangular shape is radiated onto a main reflector 1.

The subreflector 10 is a Cassegrain-type reflector whose mirror surface before the formation of asperities is a hyperboloid of revolution, and the asperities are formed by using, for example, a non-linear optimization method in such a way that a beam having a rectangular shape can be acquired.

A beam radiator is comprised of the primary radiator 9 and the subreflector 10.

Although the example in which a beam having a rectangular shape emitted from the multimode horn antenna 5 is reflected by the subreflector 7 having a rectangular aperture shape, and the beam having the rectangular shape reflected by the subreflector 7 is radiated onto the main reflector 1 is shown in above-mentioned Embodiment 4, a beam having a circular shape emitted from the primary radiator 9 can be reflected by the subreflector 10 having a rectangular aperture shape and the shape of the beam can be converted from the circular shape to a rectangular shape when reflected, so that the beam having the rectangular shape is radiated onto the main reflector 1.

Because a beam having a rectangular shape similar to the aperture shape 2 of the main reflector 1 can be radiated onto the main reflector 1 also in this case, there is provided an advantage of being able to improve the degree of freedom of reflector shaping without causing reduction in efficiency, like in the case of above-mentioned Embodiment 4.

Embodiment 7

Figure 8:
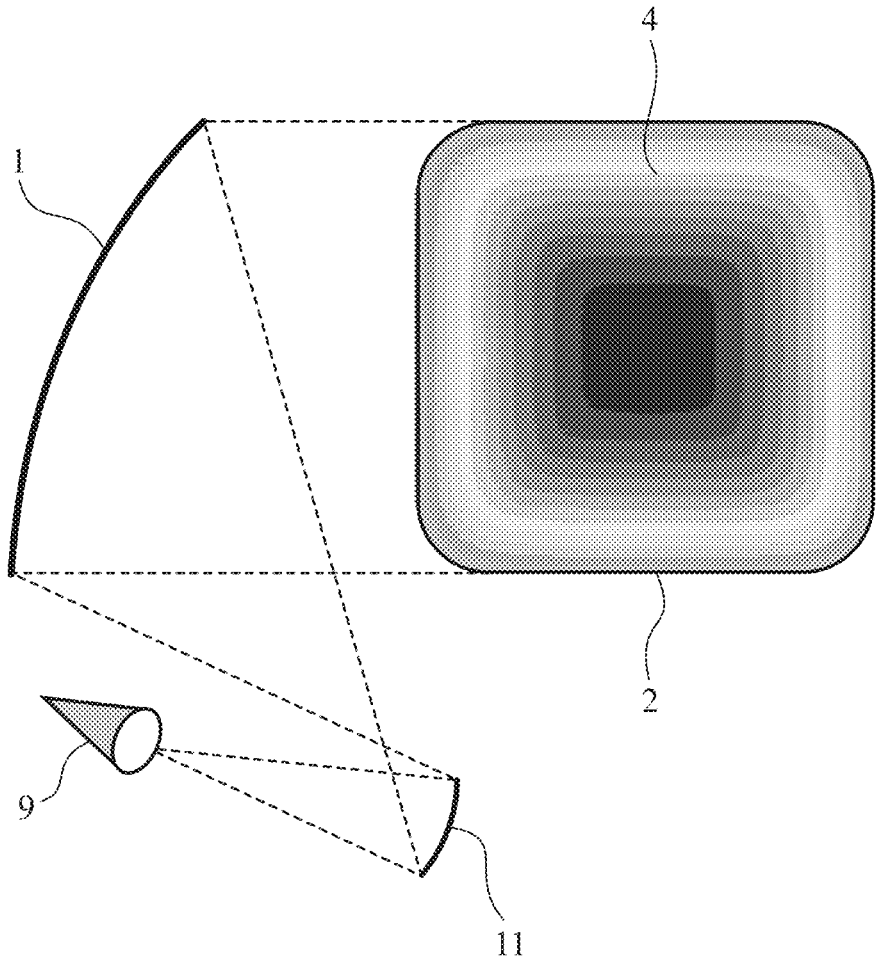
FIG. 8 is a structural diagram showing a reflector antenna device in accordance with Embodiment 7 of the present invention.

FIG. 8 is a structural diagram showing a reflector antenna device in accordance with Embodiment 7 of the present invention. In the figure, because the same reference numerals as those shown in FIG. 7 denote the same components or like components, the explanation of the components will be omitted hereafter.

A subreflector 11 has a mirror surface on which asperities are formed in order to form a beam, and has a rectangular aperture shape.

Further, the mirror surface of the subreflector 11 is shaped in such a way as to, when reflecting the beam radiated by the primary radiator 9, convert the shape of the beam from the circular shape to a rectangular shape, and the beam having the rectangular shape is radiated onto a main reflector 1.

The subreflector 11 is a Gregorian-type reflector whose mirror surface before the formation of asperities is an ellipsoid of revolution, and the asperities are formed by using, for example, a non-linear optimization method in such a way that a beam having a rectangular shape can be acquired.

A beam radiator is comprised of the primary radiator 9 and the subreflector 11.

Although the example in which a beam having a rectangular shape emitted from the multimode horn antenna 5 is reflected by the subreflector 7 having a rectangular aperture shape, and the beam having the rectangular shape reflected by the subreflector 7 is radiated onto the main reflector 1 is shown in above-mentioned Embodiment 4, a beam having a circular shape emitted from the primary radiator 9 can be reflected by the subreflector 11 having a rectangular aperture shape and the shape of the beam can be converted from the circular shape to a rectangular shape when reflected, so that the beam having the rectangular shape is radiated onto the main reflector 1.

Because a beam having a rectangular shape similar to the aperture shape 2 of the main reflector 1 can be radiated onto the main reflector 1 also in this case, there is provided an advantage of being able to improve the degree of freedom of reflector shaping without causing reduction in efficiency, like in the case of above-mentioned Embodiment 4.

While the invention has been described in its preferred embodiments, it is to be understood that an arbitrary combination of two or more of the above-mentioned embodiments can be made, various changes can be made in an arbitrary component in accordance with any one of the above-mentioned embodiments, and an arbitrary component in accordance with any one of the above-mentioned embodiments can be omitted within the scope of the invention.

INDUSTRIAL APPLICABILITY

Because the reflector antenna device in accordance with the present invention includes the main reflector that has a rectangular aperture shape, and the beam radiator that radiates a beam having a rectangular shape similar to the aperture shape of the main reflector onto the main reflector, and can improve the degree of freedom of reflector shaping without causing reduction in efficiency, the reflector antenna device is suitable for use in satellite communications and so on.

EXPLANATIONS OF REFERENCE NUMERALS

1 main reflector, 2 rectangular aperture shape, 3 primary radiator (beam radiator), 4 amplitude distribution, 5 multimode horn antenna (beam radiator), 6 active phased array antenna (beam radiator), 7 Cassegrain-type subreflector (beam radiator), 8 Gregorian-type subreflector (beam radiator), 9 primary radiator (beam radiator), 10 Cassegrain-type subreflector (beam radiator), 11 Gregorian-type subreflector (beam radiator).

The invention claimed is:

1. A reflector antenna device comprising:

a main reflector that has a rectangular aperture shape;

a primary radiator that radiates a beam initially having an amplitude distribution with a circular shape; and a subreflector that converts the shape of the beam radiated by said primary radiator from said circular shape to a rectangular shape similar to the aperture shape of said main reflector and reflects the beam, and that radiates the beam having said rectangular shape onto said main reflector to match the shape of the amplitude distribution of the beam with the rectangular shape of the aperture of said main reflector.

2. The reflector antenna device according to claim 1, wherein said subreflector is a Cassegrain-type subreflector.

3. The reflector antenna device according to claim 1, wherein said subreflector is a Gregorian-type subreflector.

* * * * *